US005932130A

United States Patent [19]

Taino

[11] Patent Number: 5,932,130

[45] Date of Patent: Aug. 3, 1999

[54] COOKING DEVICE WITH DEMONSTRATION MODE

[75] Inventor: Kazuo Taino, Shiga, Japan

[73] Assignee: Sanyo Electric Co., Ltd., Osaka, Japan

[21] Appl. No.: 09/002,033

[22] Filed: Dec. 31, 1997

[30] Foreign Application Priority Data

Jan. 27, 1997 [JP] Japan ..... 9-012839

[51] Int. Cl.[6] ..... H05B 6/66

[52] U.S. Cl. ..... 219/702

[58] Field of Search ..... 219/702, 704, 219/708, 716, 720

[56] References Cited

U.S. PATENT DOCUMENTS

| | | | |
|---|---|---|---|
| 4,375,586 | 3/1983 | Ueda et al. | 219/702 |
| 4,461,941 | 7/1984 | Fukuda et al. | 219/10.55 B |
| 4,714,811 | 12/1987 | Gerling et al. | 219/702 |
| 5,089,679 | 2/1992 | Eke et al. | 219/702 |
| 5,117,079 | 5/1992 | Morino et al. | 219/703 |
| 5,221,817 | 6/1993 | Ota et al. | 219/702 |
| 5,616,269 | 4/1997 | Fowler | 219/720 |
| 5,780,821 | 7/1998 | Choi et al. | 219/703 |

FOREIGN PATENT DOCUMENTS

| | | |
|---|---|---|
| 62-17523 | 1/1987 | Japan . |
| 1-134123 | 5/1989 | Japan . |
| 3-22539 | 3/1991 | Japan . |
| 5-332551 | 12/1993 | Japan . |
| 6-193882 | 7/1994 | Japan . |

*Primary Examiner*—Teresa Walberg
*Assistant Examiner*—Jeffrey Pwu
*Attorney, Agent, or Firm*—Armstrong, Westerman, Hattori, McLeland & Naughton

[57] ABSTRACT

A cooking device measures the temperature of an object to be heated by means of an infrared sensor when a user operates a predetermined switch, when placement of the object to be heated in the heating chamber is detected, or when it is detected that the door of the heating chamber has simply been opened in the demonstration mode with a magnetron stopped. The measured temperature is displayed on the display unit, and the temperature measuring is ended when a predetermined time period elapses. This allows actual detection of the temperature of the object to be heated in the demonstration mode and hence a more persuasive demonstration.

4 Claims, 5 Drawing Sheets

COOKING DEVICE WITH DEMONSTRATION MODE

BACKGROUND OF THE INVENTION

1. Field of the Invention

The present invention relates to a cooking device and particularly to a cooking device capable of readily demonstrating measurement of the temperature of an object to be heated at a shop or the like.

2. Description of the Related Art

In some conventional cooking devices such as microwave ovens, a so-called demonstration mode can be set for demonstrating various operations to customers at a shop.

Such a demonstration mode allows a clerk to operate the operation panel of a microwave oven in front of customers so that a heating time, a heating power and the like are set and displayed on the display panel and also to operate a timer to practically count down the heating time and the like without practically activating the magnetron of the body of the microwave oven, so as to provide an efficient demonstration.

Such a demonstration mode can be set only by a specific operation of various switches on the operation panel that general users are not informed of, so that the mode is not unnecessarily entered when users normally use the microwave oven. One example of a microwave oven capable of setting such a demonstration mode is disclosed in Japanese Patent Publication No. 3-22539 (F24C 7/02).

However, such a conventional demonstration mode of a microwave oven as described above is simply capable of the demonstration of the setting and displaying of a heating time, a heating power and the like on the operation panel and the display panel that is not associated with the actual condition of an object to be heated, and is thus incapable of demonstrating practical detection of the condition of the object to be heated while showing customers the condition of the object to be heated.

Thus, conventional demonstration modes of cooking devices such as microwave ovens can disadvantageously render a demonstration by a clerk at a shop insufficiently persuasive.

SUMMARY OF THE INVENTION

Therefore the present invention contemplates a cooking device capable of practically measuring the temperature of an object to be heated in the heating chamber in the demonstration mode to allow persuasive demonstration at a shop.

A cooking device according to the present invention includes a heating chamber for housing an object to be heated, a magnetron for supplying heating energy into the heating chamber, an infrared sensor for detecting the temperature of the object to be heated housed in the heating chamber, a display panel for displaying the detected temperature, a keyboard for entering the demonstration mode while the magnetron is held inactivated, and a circuit for setting the temperature measuring mode for activating the infrared sensor in the demonstration mode.

Thus, the present invention allows the temperature of an object to be heated for demonstration to be readily measured and displayed in the demonstration mode of a cooking device while the operation of the magnetron is stopped, and the present invention can thus provide a more persuasive demonstration to customers than conventional demonstration modes.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic front cross section of a structure of a microwave oven which each embodiment of the present invention is based on.

DESCRIPTION OF THE PREFERRED EMBODIMENTS

Figure 1:
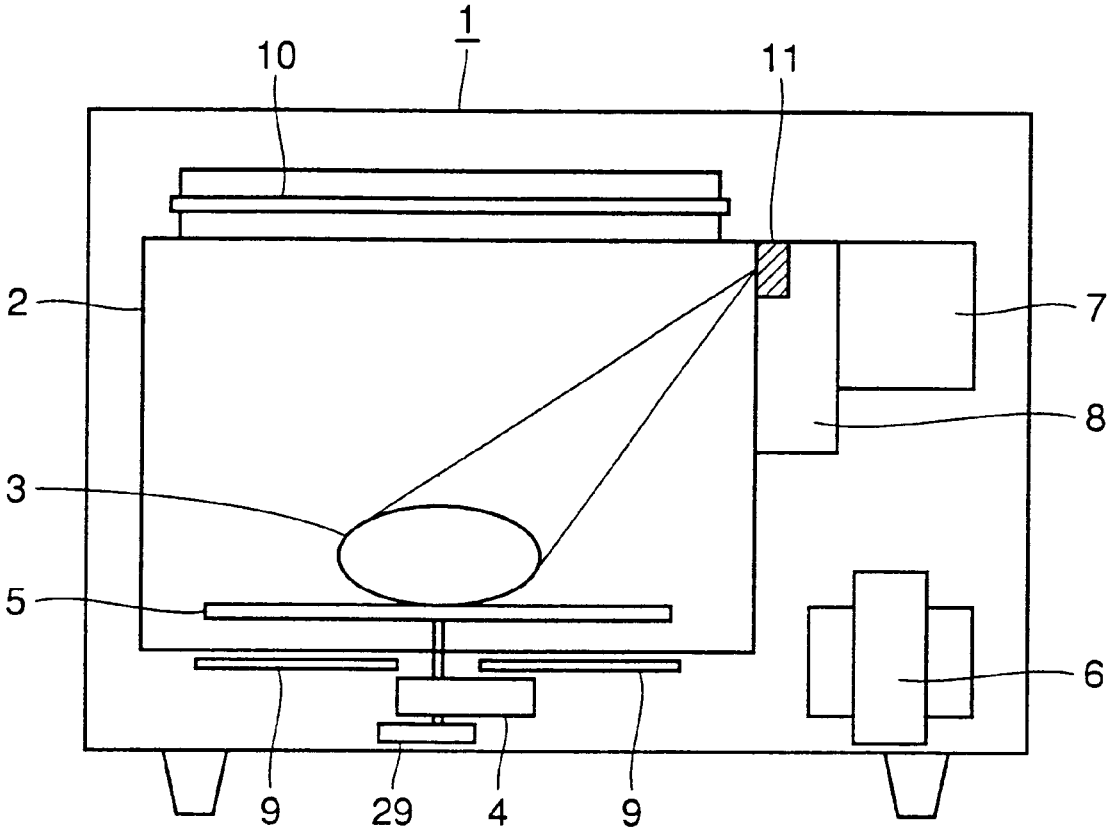

Referring to FIG. 1, a microwave oven 1 which each embodiment of the present invention is based on has a heating chamber 2 for housing a food 3 as an object to be heated. More specifically, food 3 is placed on a turntable 5 which is rotated by a turntable motor 4 in heating food 3 and is also coupled with a weight sensor 29 for detecting placement of an object to be heated.

Microwave oven 1 is provided with a magnetron 7 having power-supplied via a high voltage transformer 6. Microwave energy generated by magnetron 7 is supplied into heating chamber 2 via a waveguide 8 so that food 3 is heated by microwave.

Furthermore, heating chamber 2 is provided with a lower heater 9 on the bottom side and an upper heater 10 on the top side so that food 3 can also be heated by the heaters in addition to microwave.

Provided at an upper corner of heating chamber 2 is an infrared sensor 11 for detecting the infrared rays from food 3 to measure the temperature of food 3.

Figure 2:
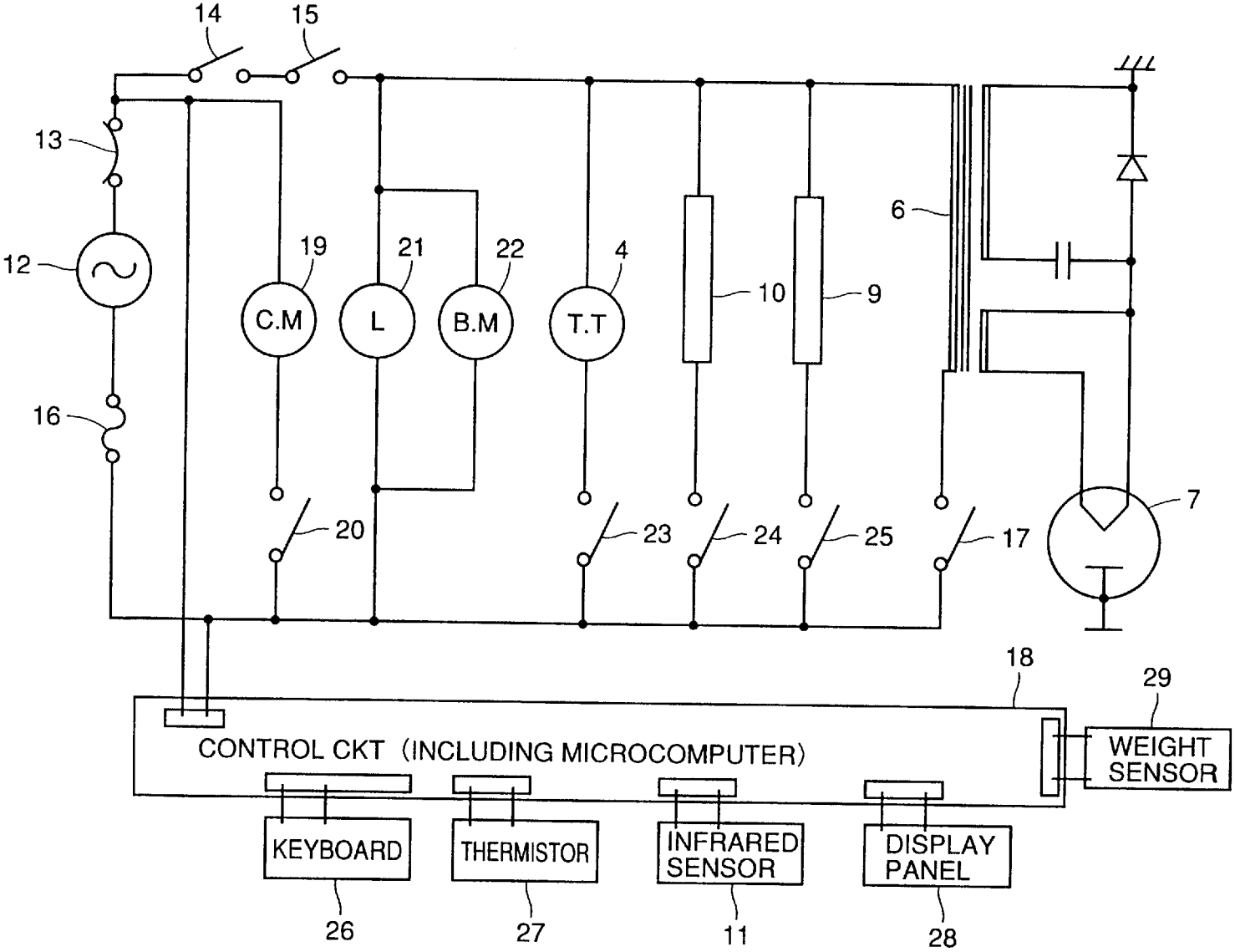
FIG. 2 is a block diagram schematically showing an electrical configuration of the microwave oven shown in FIG. 1.

Referring to FIG. 2, one power supply line from a commercial power supply 12 is connected to one end of the primary side of high voltage transformer 6 via a temperature fuse 13, a door switch 14 which opens and closes when the door (not shown) of heating chamber 2 is opened and closed, and a relay 15 which closes responsibly when a button (not shown) for starting heating is pressed.

The other power supply line from commercial power supply 12 is connected to the other end of the primary side of high voltage transformer 6 via a fuse 16 of 15A and a relay 17 which closes according to an operation of a switch (not shown) for selecting microwave-heating. The secondary side of high voltage transformer 6 is connected to magnetron 7, which is supplied with high voltage.

Commercial power supply 12 is also connected to a control circuit 18 including a microcomputer at a stage preceding door switch 14 and relay 15, and control circuit 18 is constantly power-supplied, whether the door is opened or closed and whether the start button is in the on or off state.

Similarly, commercial power supply 12 is connected to the series connection of a chopper motor 19 for infrared sensor 11 and a relay 20 at a stage preceding door switch 14 and relay 15. Accordingly, when relay 20 is closed, the chopper motor for infrared sensor 11 starts to rotate, whether the door is opened or closed and whether the start button is in the on or off state, and thus detection of the infrared rays from food 3 as an object to be heated is started.

Also connected at a stage subsequent to door switch 14 and relay 15 between the power supply lines are lamp 21 for illuminating the interior of heating chamber 2, a blower motor 22 for cooling magnetron 7, a series connection of turntable motor 4 and a relay 23, a series connection of upper heater 10 and a relay 24, and a series connection of lower heater 9 and a relay 25, which are connected in parallel with each other.

Thus, when door switch 14 and relay 15 associated with the start button are closed, lamp 21 is turned on in heating chamber 2 and blower motor 22 is driven. When relays 23, 24, 25 and 17 are closed, turntable motor 4, upper heater 10, lower heater 9 and magnetron 7 are selectively driven, respectively.

The opening and closing of relays 15, 17, 20, 23, 24 and 25 are controlled by control circuit 18 according to the operations of various buttons and switches provided on a keyboard 26. Control circuit 18 is connected to a display panel 28 for displaying various information to users, in addition to infrared sensor 11 and weight sensor 29 shown in FIG. 1. A thermistor 27 mounted to an outer wall of heating chamber 2 for indirectly measuring the temperature of the interior of the heating chamber is also connected to control circuit 18.

First Embodiment

An operation in the demonstration mode according to a first embodiment of the present invention will now be described with respect to a microwave oven having the electrical arrangement described above.

Figure 3:
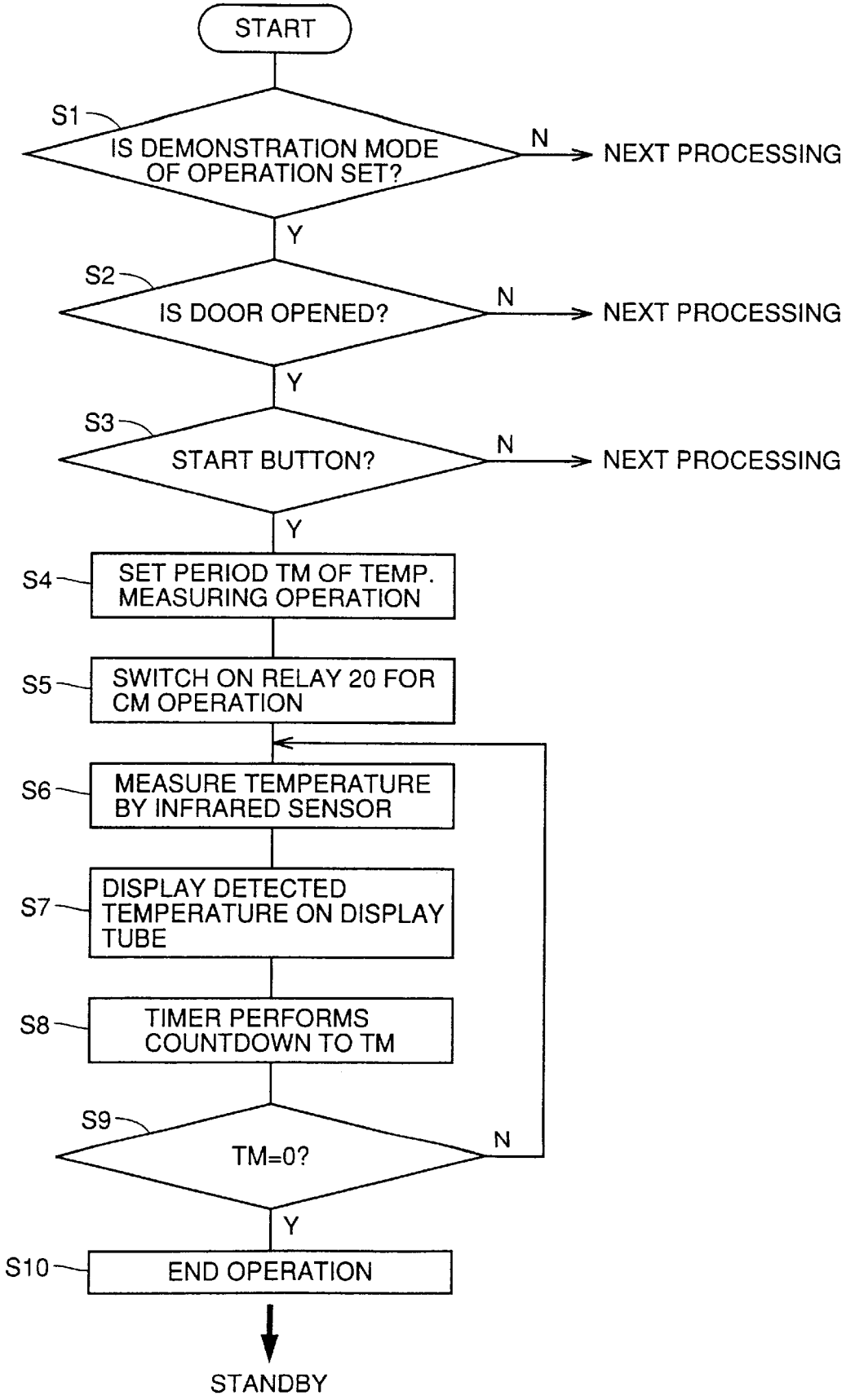
FIG. 3 is a flow chart for illustrating an operation of the demonstration mode according to a first embodiment of the present invention.

Referring to FIG. 3, it is first determined whether the demonstration mode is set by a user through a specific operation of the switches on keyboard 26. If the demonstration mode is not set, the program goes to another processing. When a decision is made that the demonstration mode is set, the program goes to the next step S2. It should be noted that in the demonstration mode, relays 17, 24 and 25 are constantly held open independently of the operation of keyboard 26 so that current is not applied to magnetron 7, lower heater 9 and upper heater 10.

It is then determined at step S2 whether the door of heating chamber 2 is opened by the user. If the door is not opened, the program goes to another processing. When a decision is made that the door is opened, the program goes to the next step S3. It is assumed that while the door is opened, the user or a clerk at a shop places an object to be heated for demonstration (e.g., a cup filled with water) on turntable 5 in heating chamber 2.

It is then determined at step S3 whether a predetermined switch (e.g., a button for starting heating) on keyboard 26 is operated. If it is not operated, the program goes to another processing. When a decision is made that it is operated, the program goes to the next step S4 and the following steps so that the temperature is measured by means of the infrared sensor.

First at step S4, a timer in control circuit 18 is set for a predetermined period for performing a temperature measuring operation.

Then at step S5, relay 20 for the chopper motor is closed and chopper motor 19 starts operating. This allows for the infrared rays from object to be heated 3 for demonstration intermittently incident on infrared sensor 11 via a chopper (not shown) rotatably driven by chopper motor 19, and the temperature of the object to be heated is thus measured. The measured temperature is displayed at step S7 by a display tube of display panel 28 to the user (the clerk) and customers.

Then, at step S8 the timer provides the countdown, and it is determined at step S9 whether a count value TM of the timer reaches zero. Steps S4–S9 are repeated until count value TM reaches zero. When it reaches zero, control circuit 18 opens relay 20 for the chopper motor at step S10 to end the temperature measuring operation by means of infrared sensor 11. Then, a standby state continues for a next processing by the user, while the demonstration mode is maintained.

According to the first embodiment described above, the temperature of an object to be heated for demonstration that is placed in the heating chamber, such as water in a cup, can be measured and displayed in the demonstration mode while the operation of the magnetron and heater is stopped. Thus, a more persuasive demonstration can be provided in front of customers than conventional demonstration modes which are limited to the demonstration on the operation panel and display panel.

Second Embodiment

An operation in the demonstration mode will now be described according to a second embodiment of the present invention.

Figure 4:
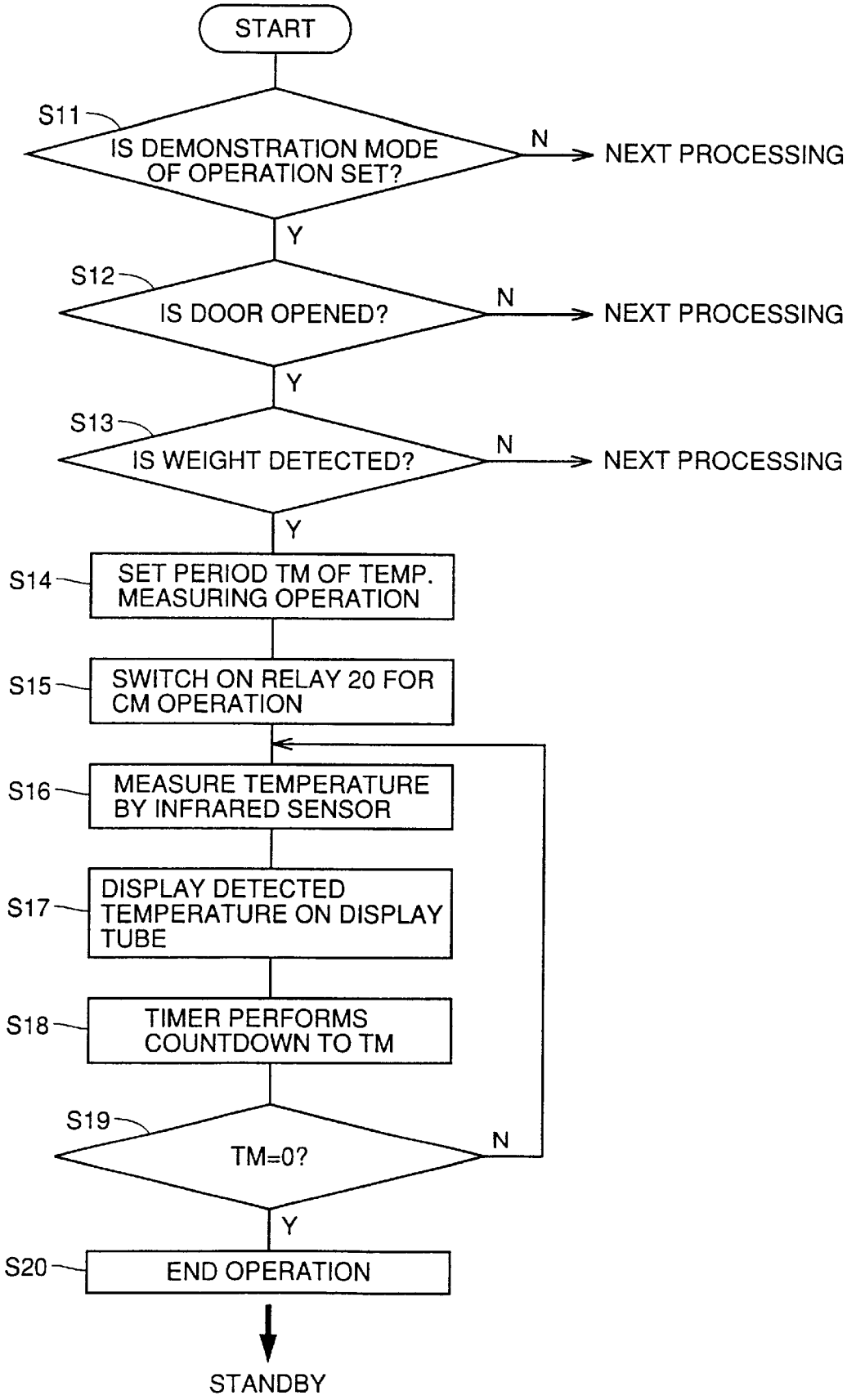
FIG. 4 is a flow chart for illustrating an operation of the demonstration mode according to a second embodiment of the present invention.

The processings from the START to step S12 in FIG. 4 are exactly the same as those from the START to step S2 of FIG. 3 according to the first embodiment, and a description thereof is thus not repeated.

The second embodiment shown in FIG. 4 differs from the first embodiment shown in FIG. 3 only in that how the temperature measuring mode by means of the infrared sensor is started at step S13. More specifically, in the first embodiment shown in FIG. 3, the temperature measuring mode is started when a user operates a predetermined switch at step S3. By contrast, in the second embodiment shown in FIG. 4, the temperature measuring operation from steps S14 to S19 are performed responsively when weight sensor 29 coupled with turntable 5 detects at step S13 that some object to be heated for demonstration has been placed on turntable 5 in heating chamber 2.

The operations of steps S14 to S20 are exactly the same as those from steps S4 to S10 of the first embodiment shown in FIG. 3, and a description thereof is thus not repeated.

The second embodiment as described above can also provide a more persuasive demonstration than conventional demonstration modes, as well as the first embodiment.

Third Embodiment

An operation of the demonstration mode will now be described according to a third embodiment of the present invention.

Figure 5:
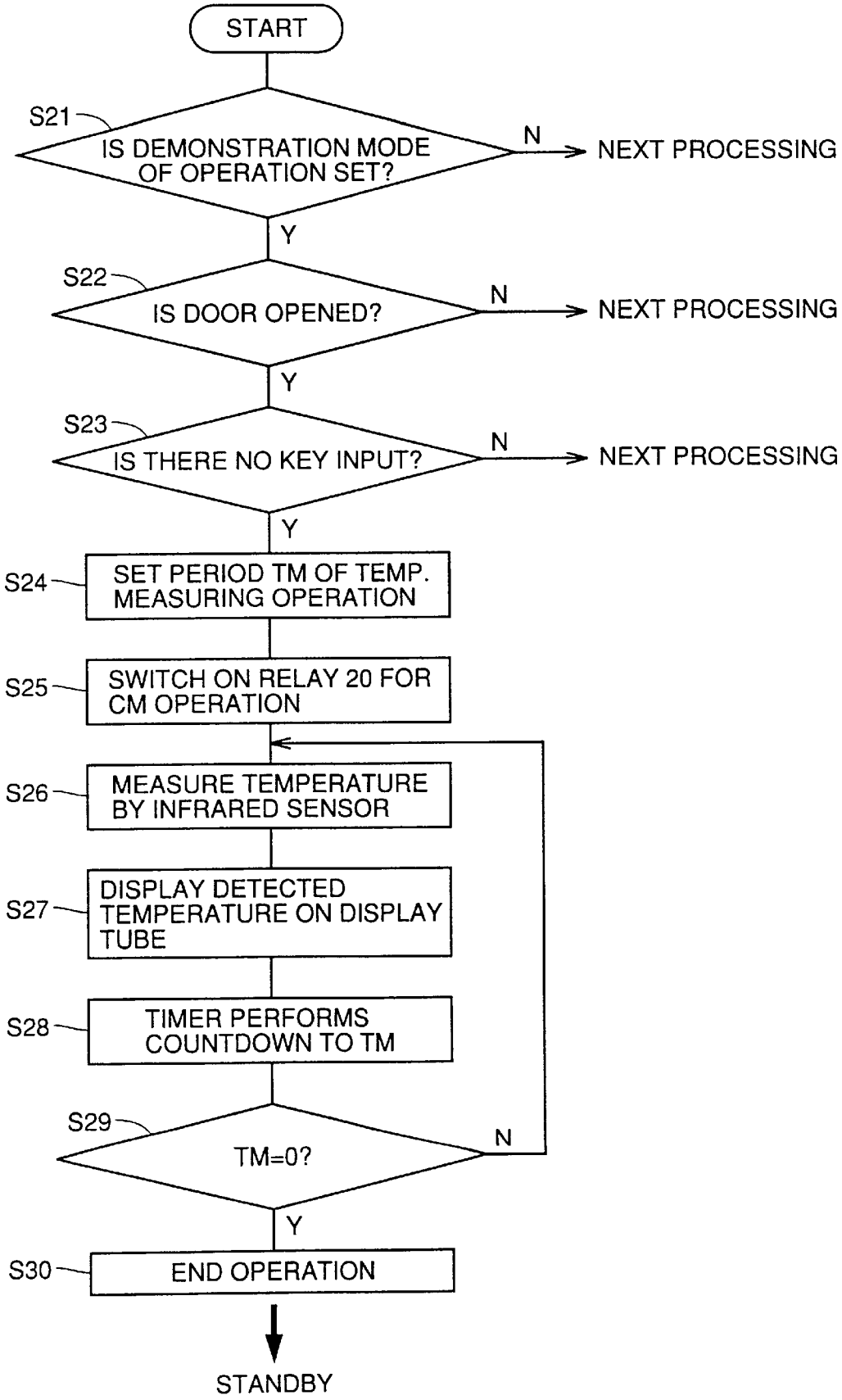
FIG. 5 is a flow chart for illustrating an operation of the demonstration mode according to a third embodiment of the present invention.

Processings from the START to step S22 shown in FIG. 5 are exactly the same as those from the START to step S2 according to the first embodiment shown in FIG. 3, and a description thereof is thus not repeated.

The third embodiment shown in FIG. 5 differs from the first embodiment shown in FIG. 3 and the second embodiment shown in FIG. 4 only in how the temperature measuring mode by means of the infrared ray sensor is started at step S23. More specifically, in the first embodiment shown in FIG. 3, the temperature measuring mode is started when a user operates a predetermined switch at step S3. In the second embodiment shown in FIG. 4, the temperature measuring mode is started when the weight sensor detects placement of an object to be heated at step S13. By contrast, in the third embodiment shown in FIG. 5, the temperature measuring operation from steps S24 to S29 is performed responsively when any key input is not detected at step S23 after a decision is made at step S22 that the door is opened. In other words, according to the third embodiment, the temperature measuring operation is directly started when the door of heating chamber 2 is opened.

The operations from steps S24 to S30 are exactly the same as those from steps S4–S10 according to the first embodiment shown in FIG. 3, and a description thereof is thus not repeated.

The third embodiment described above can also provide a more persuasive demonstration than conventional, as well as the first and second embodiments. Especially in the third embodiment, temperature detection by the infrared ray sensor is started when the door of the heating chamber is simply opened. Thus the temperature is measured and displayed, for example, when a clerk simply puts his or her hand into the heating chamber at the shop and thus temperature measurement can be more readily demonstrated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking device which can be switched to a demonstration mode for demonstration in front of customers, comprising:

a heating chamber for housing an object to be heated;

heating energy generation means for supplying heating energy into said heating chamber;

an infrared sensor for detecting a temperature of the object to be heated housed in said heating chamber;

display means for displaying a temperature detected;

demonstration mode setting means for entering said demonstration mode while said heating energy generation means is held inactivated; and temperature-measuring-mode setting means for activating said infrared sensor in said demonstration mode, wherein said temperature-measuring-mode setting means include means for starting an operation of said infrared sensor by detecting placement of said object to be heated in said heating chamber.

2. A cooking device which can be switched to a demonstration mode for demonstration in front of customers, comprising:

a heating chamber for housing an object to be heated;

heating energy generation means for supplying heating energy into said heating chamber;

an infrared sensor for detecting a temperature of the object to be heated housed in said heating chamber;

display means for displaying a temperature detected;

demonstration mode setting means for entering said demonstration mode while said heating energy generation means is held inactivated; and temperature-measuring-mode setting means for activating said infrared sensor in said demonstration mode, wherein said temperature-measuring-mode setting means includes means for starting an operation of said infrared sensor when a user opens a door of said heating chamber.

3. The cooking device according to claim 1, further comprising operation stopping means for stopping the operation of said infrared sensor when a predetermined time period elapses after the operation of said infrared sensor is started.

4. The cooking device according to claim 2, further comprising operation stopping means for stopping the operation of said infrared sensor when a predetermined time period elapses after the operation of said infrared sensor is started.

* * * * *